US011705046B2

(12) United States Patent
Hwang et al.

(10) Patent No.: US 11,705,046 B2
(45) Date of Patent: Jul. 18, 2023

(54) DATA DRIVER WITH SAMPLE/HOLD CIRCUIT AND DISPLAY DEVICE INCLUDING THE SAME

(71) Applicants: SAMSUNG DISPLAY CO., LTD., Yongin-si (KR); Korea University Research and Business Foundation, Seoul (KR)

(72) Inventors: Young Soo Hwang, Hwaseong-si (KR); Joon Chul Goh, Suwon-si (KR); Oh Jo Kwon, Suwon-si (KR); Ki Duk Kim, Daejeon (KR); Jeong Min Kim, Seoul (KR); Bong Hyun You, Seoul (KR); Hyung Min Lee, Seoul (KR); Seung Hun Choi, Gunpo-si (KR)

(73) Assignees: SAMSUNG DISPLAY CO., LTD., Yongin-si (KR); KOREA UNIVERSITY RESEARCH & BUSINESS FOUNDATION, Seoul (KR)

( * ) Notice: Subject to any disclaimer, the term of this patent is extended or adjusted under 35 U.S.C. 154(b) by 0 days.

(21) Appl. No.: 17/471,997

(22) Filed: Sep. 10, 2021

(65) Prior Publication Data

US 2022/0122513 A1 Apr. 21, 2022

(30) Foreign Application Priority Data

Oct. 19, 2020 (KR) ..... 10-2020-0135436

(51) Int. Cl.
*G09G 3/20* (2006.01)

(52) U.S. Cl.
CPC ..... *G09G 3/2092* (2013.01); *G09G 2310/027* (2013.01); *G09G 2310/0291* (2013.01); *G09G 2310/0294* (2013.01); *G09G 2310/08* (2013.01)

(58) Field of Classification Search
None
See application file for complete search history.

(56) References Cited

U.S. PATENT DOCUMENTS 5,170,158 A * 12/1992 Shinya ..... G09G 3/3688 345/98
10,497,308 B1 * 12/2019 Tseng ..... G09G 3/3233
(Continued)

FOREIGN PATENT DOCUMENTS

KR 10-1035925 5/2011
KR 10-2017-0015749 2/2017
(Continued)

OTHER PUBLICATIONS

An, et al., "Area-efficient Ramp Signal-based Column Driving Technique for AMOLED Panels", Journal of Semiconductor Technology and Science, vol. 19, No. 4, Aug. 2019, 10 pages.

*Primary Examiner* — Chad M Dicke
(74) *Attorney, Agent, or Firm* — F. Chau & Associates, LLC

(57) ABSTRACT

A data driver includes a multi-channel sample/hold circuit electrically connected between a digital-to-analog converter and a data buffer. The multi-channel sample/hold circuit includes a first sample/hold circuit connected to a first channel and a second sample/hold circuit connected to a second channel. The first sample/hold circuit performs a first drive operation and a second drive operation. The first drive operation includes sampling a data voltage as a buffer input voltage and maintaining the buffer input voltage during an $n^{th}$ horizontal time. The second drive operation includes outputting the buffer input voltage to an output terminal of the buffer during an $(n+1)^{th}$ horizontal time. The second sample/hold circuit performs the second drive operation
(Continued)

during the $n^{th}$ horizontal time and performs the first drive operation during the $(n+1)^{th}$ horizontal time.

20 Claims, 9 Drawing Sheets

(56) References Cited

U.S. PATENT DOCUMENTS

| | | | | |
|---|---|---|---|---|
| 2005/0041128 | A1* | 2/2005 | Baker | H04N 5/335<br>348/308 |
| 2011/0032129 | A1* | 2/2011 | Tu | G09G 3/3648<br>341/122 |

FOREIGN PATENT DOCUMENTS

| | | |
|---|---|---|
| KR | 10-2017-0036175 | 4/2017 |
| KR | 10-2017-0121676 | 11/2017 |

* cited by examiner

DATA DRIVER WITH SAMPLE/HOLD CIRCUIT AND DISPLAY DEVICE INCLUDING THE SAME

CROSS-REFERENCE TO RELATED APPLICATIONS

This application claims priority under 35 U.S.C. § 119 to Korean Patent Application No. 10-2020-0135436, filed on Oct. 19, 2020, in the Korean Intellectual Property Office KIPO, the contents of which are herein incorporated by reference in their entirety.

BACKGROUND

1. Field

One or more embodiments described herein relate to a data driver and a display device including a display driver.

2. Description of the Related Art

Display devices use a data driver to control a display panel. The data driver may include a sample/hold circuit that performs a sample operation and a holding operation during a first half horizontal time (½H) and a driving operation during a second half horizontal time (½H). In the case of driving a high-speed high-resolution display, the first half horizontal time is relatively short. Thus, the settling time for a buffer input voltage may be insufficient or power consumption of the sample/hold circuit may be increased.

SUMMARY

One or more embodiments described herein provide a data driver which increases sample/hold operation time to one horizontal time (1H). This may reduce operating frequency, which, in turn, may reduce power consumption.

These or other embodiments may provide a data driver including a source follower in a front end of a sampling capacitor.

One or more embodiments may also provide a display device including a data driver as described herein.

In accordance with one or more embodiments, a data driver includes a digital-to-analog converter configured to convert a digital data signal to an analog data voltage, a buffer configured to output the data voltage, and a multi-channel sample/hold circuit electrically connected between the digital-to-analog converter and the buffer, the multi-channel sample/hold circuit including a first sample/hold circuit connected to a first channel and a second sample/hold circuit connected to a second channel. The first sample/hold circuit performs a first drive operation of sampling the data voltage as a buffer input voltage and maintaining the buffer input voltage during an $n^{th}$ horizontal time, and performs a second drive operation of outputting the buffer input voltage to an output terminal of the buffer during an $(n+1)^{th}$ horizontal time. The second sample/hold circuit performs the second drive operation during the $n^{th}$ horizontal time and to perform the first drive operation during the $(n+1)^{th}$ horizontal time, where n is an integer greater than or equal to 1.

In accordance with one or more embodiments, a display device includes a display panel, a gate driver configured to apply a gate signal to the display panel, a data driver configured to apply an analog data voltage to the display panel, and a timing controller configured to control the gate driver and the data driver. The data driver includes a digital-to-analog converter configured to convert a digital data signal to an analog data voltage, a buffer configured to output the data voltage, and a multi-channel sample/hold circuit electrically connected between the digital-to-analog converter and the buffer, the multi-channel sample/hold circuit including a first sample/hold circuit connected to a first channel and a second sample/hold circuit connected to a second channel. The first sample/hold circuit is configured to perform a first drive operation of sampling the data voltage as a buffer input voltage and maintaining the buffer input voltage during an $n^{th}$ horizontal time, and to perform a second drive operation of outputting the buffer input voltage to an output terminal of the buffer during an $(n+1)^{th}$ horizontal time. The second sample/hold circuit is configured to perform the second drive operation during the $n^{th}$ horizontal time and perform the first drive operation during the $(n+1)^{th}$ horizontal time, where n is an integer greater than or equal to 1.

In an embodiment, the first sample/hold circuit includes a first sampling capacitor configured to store the buffer input voltage, a first source follower including an input terminal configured to selectively receive the data voltage or the buffer output voltage and an output terminal connected to a first terminal of the first sampling capacitor, a first input switch set configured to selectively apply the data voltage or the buffer output voltage to the input terminal of the first source follower and a first output switch set configured to control a connection between a second terminal of the first sampling capacitor and first and second input terminals of the buffer.

In an embodiment, the second sample/hold circuit includes a second sampling capacitor configured to store the buffer input voltage, a second source follower including an input terminal configured to selectively receive the data voltage or the buffer output voltage and an output terminal connected to a first terminal of the second sampling capacitor, a second input switch set configured to selectively apply the data voltage or the buffer output voltage to the input terminal of the second source follower and a second output switch set configured to control a connection between a second terminal of the second sampling capacitor and the first and second input terminals of the buffer.

In an embodiment, the output terminal of the buffer and the input terminal of the first source follower are connected to each other through a first feedback line, and the output terminal of the buffer and the input terminal of the second source follower are connected to each other through a second feedback line.

In an embodiment, the first input switch set includes a first switch configured to control a connection between an output terminal of the digital-to-analog converter through which the data voltage is output and the input terminal of the first source follower and a second switch located on the first feedback line and configured to control a connection between the output terminal of the buffer and the input terminal of the first source follower.

In an embodiment, the first output switch set includes a fourth switch configured to control a connection between the second terminal of the first sampling capacitor and the first input terminal of the buffer and a third switch configured to control a connection between the second terminal of the first sampling capacitor and the second input terminal of the buffer.

In an embodiment, the second input switch set includes a fifth switch configured to control a connection between the output terminal of the digital-to-analog converter through which the data voltage is output and the input terminal of the second source follower and a sixth switch located on the second feedback line and configured to control a connection between the output terminal of the buffer and the input terminal of the second source follower.

In an embodiment, the second output switch set includes an eighth switch configured to control a connection between the second terminal of the second sampling capacitor and the first input terminal of the buffer and a seventh switch configured to control a connection between the second terminal of the second sampling capacitor and the second input terminal of the buffer.

In an embodiment, when the first sample/hold circuit performs the first drive operation, the sixth switch and the eighth switch are turned on, and the second switch, the fourth switch, the fifth switch, and the seventh switch are turned off.

In an embodiment, when the first sample/hold circuit performs the second drive operation, the second switch and the fourth switch are turned on, and the first switch, the third switch, the sixth switch, and the eighth switch are turned off.

In an embodiment, the first sample/hold circuit is configured to sample the data voltage as the buffer input voltage when the first switch, the third switch, the sixth switch, and the eighth switch are turned on, and the second switch, the fourth switch, the fifth switch, and the seventh switch are turned off, and the first sample/hold circuit is configured to maintain the buffer input voltage when the sixth switch and the eighth switch are turned on, and the first switch, the second switch, the third switch, the fourth switch, the fifth switch, and the seventh switch are turned off.

In an embodiment, when the second sample/hold circuit performs the first drive operation, the second switch and the fourth switch are turned on, the first switch, the third switch, the sixth switch, and the eighth switch are turned off.

In an embodiment, when the second sample/hold circuit performs the second drive operation, the sixth switch and the eighth switch are turned on, and the second switch, the fourth switch, the fifth switch, and the seventh switch are turned off.

In an embodiment, the second sample/hold circuit is configured to sample the data voltage as the buffer input voltage when the second switch, the fourth switch, the fifth switch, and the seventh switch are turned on, and the first switch, the third switch, the sixth switch, and the eighth switch are turned off, and the second sample/hold circuit is configured to maintain the buffer input voltage when the second switch and the fourth switch are turned on, and the first switch, the third switch, the fifth switch, the sixth switch, the seventh switch, and the eighth switch are turned off.

In an embodiment of a display device according to the present inventive concept, the display device may include a display panel, a gate driver configured to apply a gate signal to the display panel, a data driver configured to apply an analog data voltage to the display panel and a timing controller configured to control the gate driver and the data driver. Here, the data driver includes a digital-to-analog converter configured to receive a digital data signal to convert the received digital data signal into an analog data voltage, a buffer configured to output the data voltage and a multi-channel sample/hold circuit located between the digital-to-analog converter and the buffer and including a first sample/hold circuit connected to a first channel and a second sample/hold circuit connected to a second channel. The first sample/hold circuit is configured to perform a first drive operation of sampling the data voltage as a buffer input voltage and maintaining the buffer input voltage during an nth horizontal time (where n is an integer greater than or equal to 1), and perform a second drive operation of outputting the buffer input voltage to an output terminal of the buffer during an (n+1)th horizontal time, and the second sample/hold circuit is configured to perform the second drive operation during the nth horizontal time and perform the first drive operation during the (n+1)th horizontal time.

In an embodiment, the first sample/hold circuit includes a first sampling capacitor configured to store the buffer input voltage, a first source follower including an input terminal configured to selectively receive the data voltage or the buffer output voltage and an output terminal connected to a first terminal of the first sampling capacitor, a first input switch set configured to selectively apply the data voltage or the buffer output voltage to the input terminal of the first source follower and a first output switch set configured to control a connection between a second terminal of the first sampling capacitor and first and second input terminals of the buffer.

In an embodiment, the second sample/hold circuit includes a second sampling capacitor configured to store the buffer input voltage, a second source follower including an input terminal configured to selectively receive the data voltage or the buffer output voltage and an output terminal connected to a first terminal of the second sampling capacitor, a second input switch set configured to selectively apply the data voltage or the buffer output voltage to the input terminal of the second source follower and a second output switch set configured to control a connection between a second terminal of the second sampling capacitor and the first and second input terminals of the buffer.

In an embodiment, the output terminal of the buffer and the input terminal of the first source follower are connected to each other through a first feedback line, and the output terminal of the buffer and the input terminal of the second source follower are connected to each other through a second feedback line.

In an embodiment, the first input switch set includes a first switch configured to control a connection between an output terminal of the digital-to-analog converter through which the data voltage is output and the input terminal of the first source follower and a second switch located on the first feedback line and configured to control a connection between the output terminal of the buffer and the input terminal of the first source follower, and the first output switch set includes a fourth switch configured to control a connection between the second terminal of the first sampling capacitor and the first input terminal of the buffer and a third switch configured to control a connection between the second terminal of the first sampling capacitor and the second input terminal of the buffer.

In an embodiment, the second input switch set includes a fifth switch configured to control a connection between the output terminal of the digital-to-analog converter through which the data voltage is output and the input terminal of the second source follower and a sixth switch located on the second feedback line and configured to control a connection between the output terminal of the buffer and the input terminal of the second source follower, and the second output switch set includes an eighth switch configured to control a connection between the second terminal of the second sampling capacitor and the first input terminal of the buffer and a seventh switch configured to control a connection between the second terminal of the second sampling capacitor and the second input terminal of the buffer.

According to embodiments of the present inventive concept, the data driver and the display device including the same are subject to time-division simultaneous driving such that a driving operation is performed in the second sample/hold circuit when a sampling operation and a holding operation are performed in the first sample/hold circuit, and the driving operation is performed in the first sample/hold circuit when the sampling operation and the holding operation are performed in the second sample/hold circuit, so that a time required for the sampling and holding operations can be doubled in a high-speed high-resolution display. Therefore, a settling time for the buffer input voltage can be increased, so that signal distortion and signal transmission errors can be prevented.

In addition, according to the data driver and the display device including the same of the embodiments of the present inventive concept, a source follower inside the multi-channel sample/hold circuit is disposed in a front end of the sampling capacitor so as to be connected in series with the sampling capacitor, so that an equivalent capacitance inside the sample/hold circuit can be reduced, and thus a problem caused by an RC delay can be solved.

Moreover, according to the embodiments of the present inventive concept, the data driver and the display device including the same have a configuration in which the buffer output voltage is fed back to an input terminal of the source follower, so that the data voltage input from the digital-to-analog converter can be output to the output terminal of the buffer without voltage drop.

DETAILED DESCRIPTION OF THE EMBODIMENTS

Figure 1:
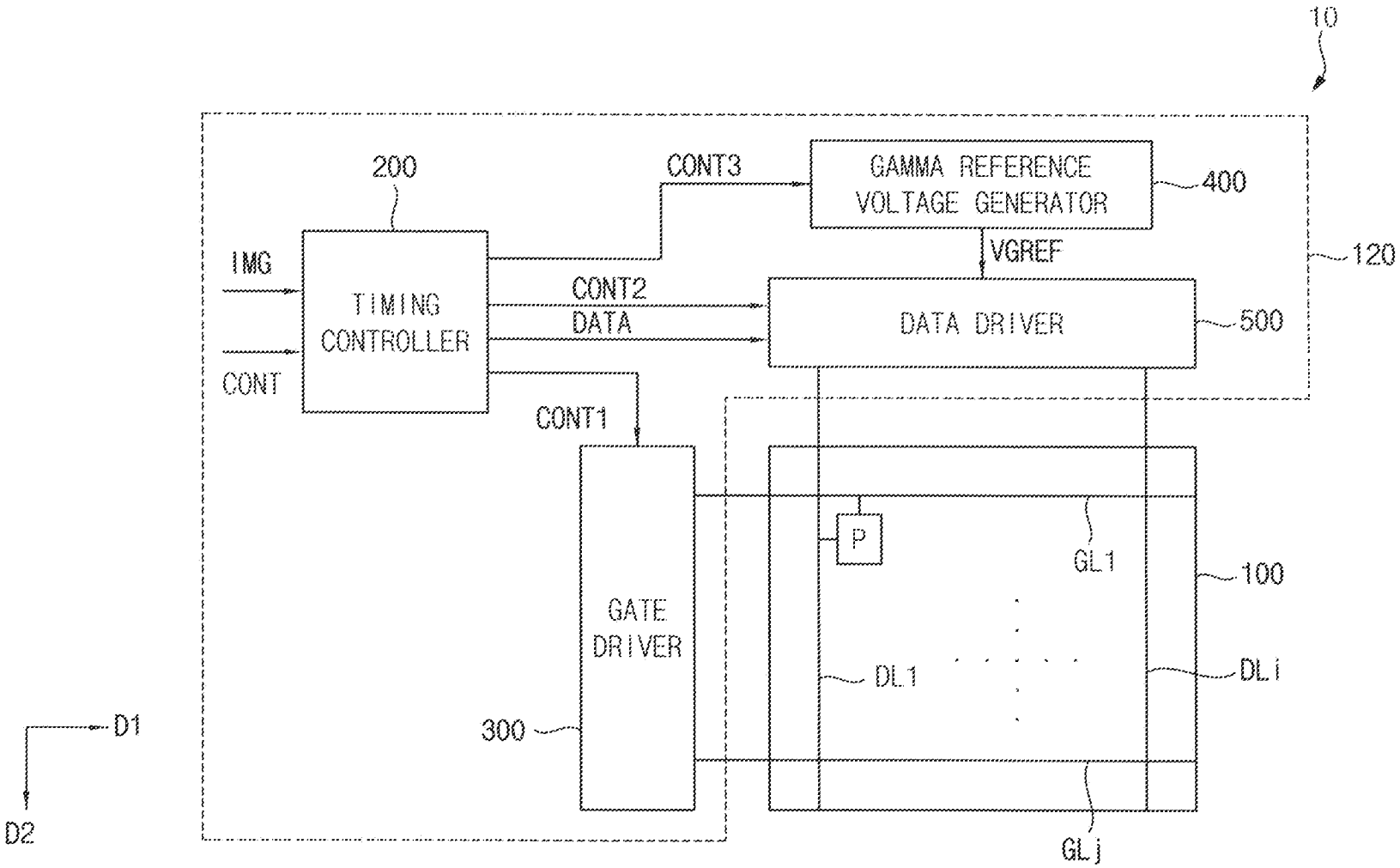
FIG. 1 illustrates an embodiment of a display device.

Hereinafter, embodiments of the present inventive concept will be described in more detail with reference to the accompanying drawings. Like reference numerals will be used for like elements in the drawings, and redundant descriptions of like elements will be omitted.

FIG. 1 is a block diagram illustrating an embodiment of a display device 10, which may include a display panel 100 and a display panel driver 120. The display panel driver 120 may include a timing controller 200, a gate driver 300, a gamma reference voltage generator 400, and a data driver 500.

The display panel 100 may include a display area for displaying an image and a peripheral area adjacent to the display area. The display panel 100 may include pixels P and may display an image corresponding to input image data based on light output from the pixels P. Gate lines GL1 to GLj may extend in a first direction D1, and data lines DL1 to DLi may extend in a second direction D2 intersecting the first direction D1.

The timing controller 200 may receive input image data IMG and an input control signal CONT from an external device. For example, the input image data IMG received from the external device may include image data of a plurality of colors, e.g., red, green, and blue. In some embodiments, the input image data IMG may further include white image data. In one embodiment, the input image data IMG may include magenta image data, yellow image data, and cyan image data. The input control signal CONT received from the external device may include a master clock signal, a data enable signal, a vertical synchronization signal, a horizontal synchronization signal, and/or other signals.

The timing controller 200 may generate a first control signal CONT1, a second control signal CONT2, a third control signal CONT3, and a data signal DATA based on the input image data IMG and the input control signal CONT. The timing controller 200 may generate the first control signal CONT1 for controlling operation of the gate driver 300 based on the input control signal CONT and output the generated first control signal CONT1 to the gate driver 300. The first control signal CONT1 may include, for example, a vertical start signal and a gate clock signal.

The timing controller 200 may generate the second control signal CONT2 for controlling operation of the data driver 500 based on the input control signal CONT and output the generated second control signal CONT2 to the data driver 500. The second control signal CONT2 may include, for example, a horizontal start signal and a load signal.

The timing controller 200 may generate the data signal DATA based on the input image data IMG and output the generated data signal DATA to the data driver 500.

The timing controller 200 may generate the third control signal CONT3 for controlling operation of the gamma reference voltage generator 400 based on input control signal CONT. The timing controller 200 may output the generated third control signal CONT3 to the gamma reference voltage generator 400

The gate driver 300 may generate gate signals for driving the gate lines GL1 to GLj in response to the first control signal CONT1 from the timing controller 200. The gate driver 300 may output the generated gate signals to the gate lines GL1 to GLj. For example, the gate driver 300 may sequentially output the gate signals to the gate lines GL1 to GLj. In some embodiments, the gate driver 300 may be mounted on the peripheral area of the display panel.

The gamma reference voltage generator 400 may generate a gamma reference voltage VGREF in response to the third control signal CONT3 from the timing controller 200.

The gamma reference voltage generator 400 may provide the generated gamma reference voltage VGREF to the data driver 500. The gamma reference voltage VGREF may have a value corresponding to each data signal DATA. In some embodiments, the gamma reference voltage generator 400 may be disposed inside the timing controller 200 or inside the data driver 500.

The data driver 500 may receive the second control signal CONT2 and the data signal DATA from the timing controller 200, and may receive the gamma reference voltage VGREF from the gamma reference voltage generator 400. The data driver 500 may convert a digital data signal DATA to an analog data voltage using the gamma reference voltage VGREF. The data driver 500 may output the data voltage to the data lines DL1 to DLi. An embodiment of the data driver 500 is described with reference to FIGS. 2 to 4.

Figure 2:
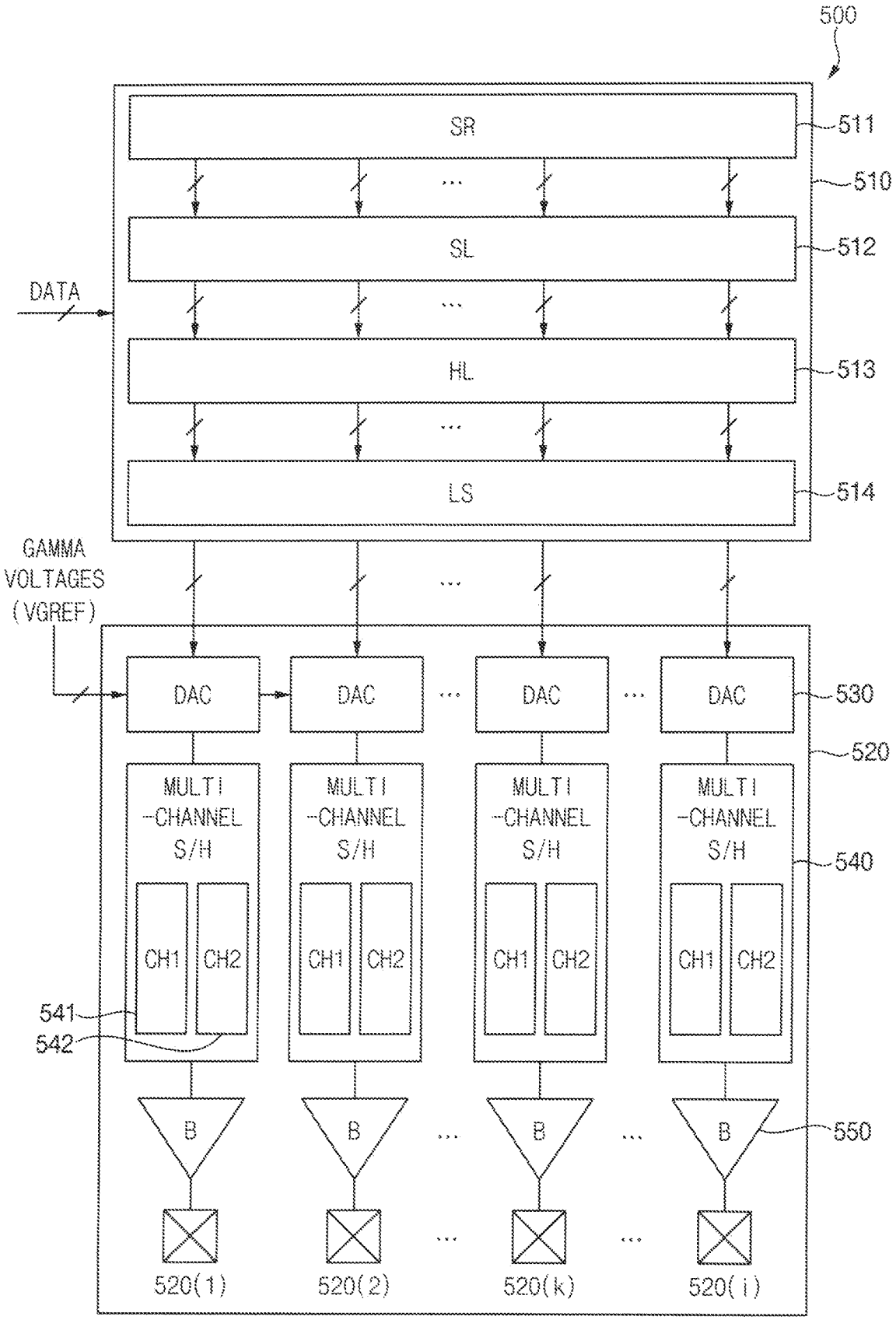
FIG. 2 illustrates an embodiment of a data driver.
Figure 3:
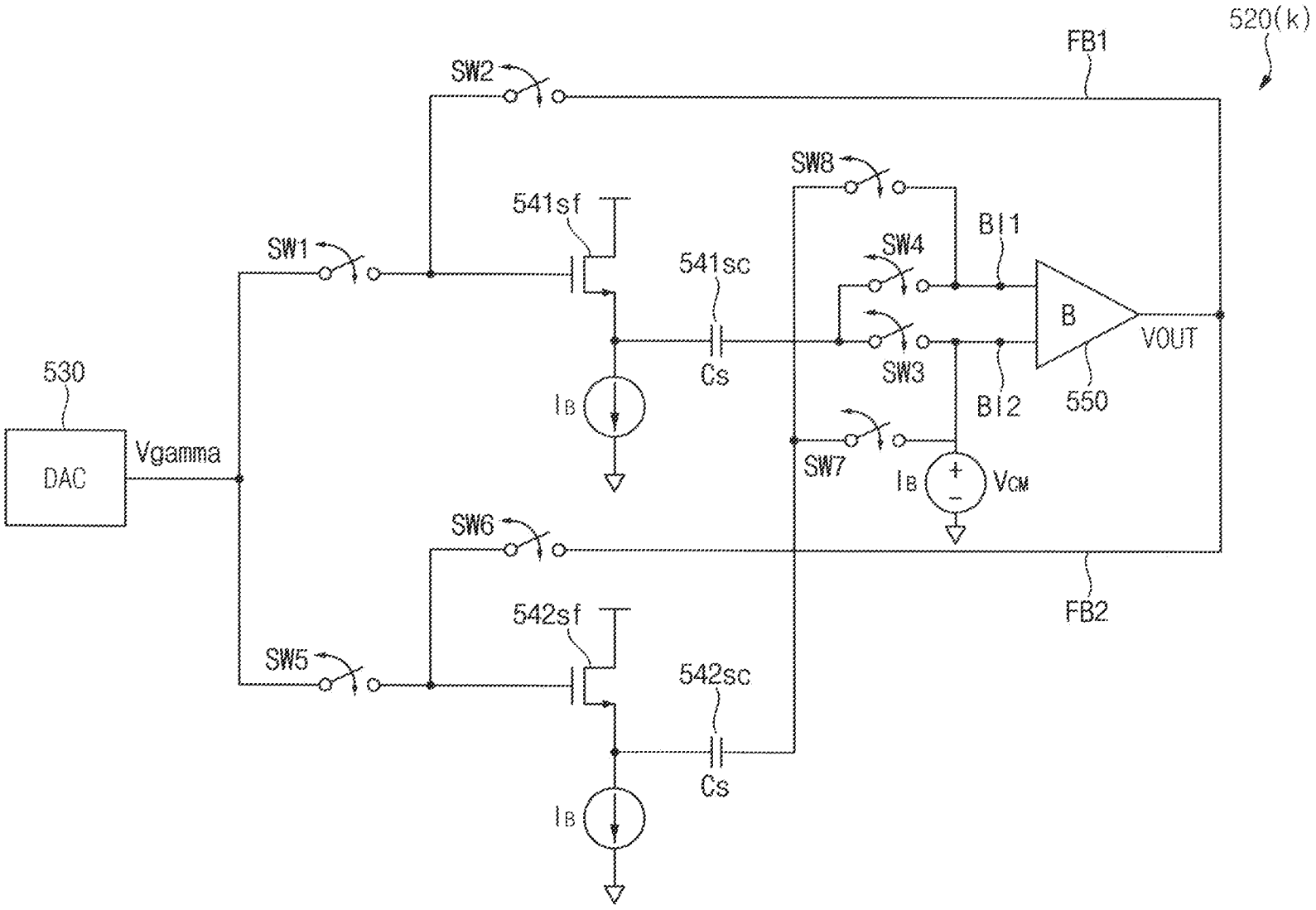
FIG. 3 illustrates an embodiment of an analog driving circuit.

FIG. 2 is a block diagram illustrating an embodiment of a data driver of the display device 10 of FIG. 1, and FIG. 3 is a circuit diagram illustrating an embodiment of an analog driving circuit 520(*k*) of the data driver 500 of FIG. 2.

Referring to FIG. 2, the data driver 500 may include a digital driving block 510 and an analog driving block 520. The digital driving block 510 may include a shift register 511, a sampling latch 512, a holding latch 513, and a level shifter 514. The shift register 511 may sequentially move the data signal DATA. The sampling latch 512 and the holding latch 513 may receive the data signal DATA to temporarily store the data signal DATA. The level shifter 514 may shift (e.g., increase) a level of the data signal DATA.

The analog driving block 520 may include first to ith analog driving circuits 520(1) to 520(*i*), where i is an integer greater than or equal to 2. One analog driving circuit 520(*k*) may include a digital-to-analog converter 530, a multi-channel sample/hold circuit 540, and a buffer 550. The value of k may be an integer greater than or equal to 1 and less than or equal to i.

The digital-to-analog converter 530 may convert the digital data signal DATA to the analog data voltage based on the gamma reference voltage VGREF.

The multi-channel sample/hold circuit 540 may sample the data voltage as a buffer input voltage and maintain the buffer input voltage.

The buffer 550 may amplify the buffer input voltage and output the amplified buffer input voltage to a corresponding data line DLk of the display panel 100. Buffers 550 included in the first to ith analog driving circuits 520(1) to 520(*i*) may be connected to first to ith data lines DL1 to DLi, respectively. In this case, the number of the buffers 550 in the analog driving block 520 may be equal to the number of the data lines DL1 to DLi.

As shown in FIG. 2, the analog driving circuit 520(*k*) may include a digital-to-analog converter 530 configured to convert the digital data signal to an analog data voltage, a buffer 550 configured to amplify and output the buffer input voltage, and a multi-channel sample/hold circuit 540 located between the digital-to-analog converter 530 and the buffer 550 and including a first sample/hold circuit 541 corresponding to a first channel and a second sample/hold circuit 542 corresponding to a second channel.

Referring to FIGS. 2 and 3, the first sample/hold circuit 541 and the second sample/hold circuit 542 may be connected in parallel in the multi-channel sample/hold circuit 540. An output terminal of the digital-to-analog converter 530 may be selectively connected to the first sample/hold circuit 541 and the second sample/hold circuit 542. An output terminal of the first sample/hold circuit 541 may be selectively connected to a first input terminal BI1 and a second input terminal BI2 of the buffer 550. An output terminal of the second sample/hold circuit 542 may be selectively connected to the first input terminal BI1 and the second input terminal BI2 of the buffer 550. For example, the output terminal of the digital-to-analog converter 530 may be connected to the first sample/hold circuit 541, the output terminal of the first sample/hold circuit 541 may be connected to the second input terminal BI2 of the buffer 550, and the output terminal of the second sample/hold circuit 542 may be connected to the first input terminal BI1 of the buffer 550. In one embodiment, the output terminal of the digital-to-analog converter 530 may be connected to the second sample/hold circuit 542, the output terminal of the first sample/hold circuit 541 may be connected to the first input terminal BI1 of the buffer 550, and the output terminal of the second sample/hold circuit 542 may be connected to the second input terminal BI2 of the buffer 550.

The first sample/hold circuit 541 may perform a first drive operation of sampling the data voltage as the buffer input voltage and maintaining the buffer input voltage during an nth horizontal time (where n is an integer greater than or equal to 1). The first sample/hold circuit 541 may also perform a second drive operation of inputting the buffer input voltage to an input terminal of the buffer 550 during an (n+1)th horizontal time. The first drive operation may include an operation of sampling a received data voltage and an operation of maintaining the buffer input voltage in a sampling capacitor. The second drive operation may include a driving operation of amplifying the maintained buffer input voltage and outputting the amplified buffer input voltage to an output terminal of the buffer 550.

The second sample/hold circuit 542 may perform the second drive operation during the nth horizontal time, and may perform the first drive operation during the (n+1)th horizontal time. For example, while the first sample/hold circuit 541 performs the operation of sampling the data voltage and the operation of maintaining the buffer input voltage during the nth horizontal time, the second sample/hold circuit 542 may perform the driving operation of amplifying the buffer input voltage maintained in a previous horizontal time (e.g., an (n−1)th horizontal time) and outputting the amplified buffer input voltage to the output terminal of the buffer 550.

The second sample/hold circuit 542 may perform the first drive operation of sampling the data voltage as the buffer input voltage and maintaining the buffer input voltage during the (n+1)th horizontal time, and may perform the second drive operation of inputting the buffer input voltage to the input terminal of the buffer 550 during an (n+2)th horizontal time. The first sample/hold circuit 541 may perform the second drive operation during the (n+1)th horizontal time and may perform the first drive operation during the (n+2)th horizontal time. For example, while the second sample/hold circuit 542 performs the operation of sampling the data voltage and the operation of maintaining the buffer input voltage during the (n+1)th horizontal time, the first sample/hold circuit 541 may perform the driving operation of amplifying the buffer input voltage maintained in a previous horizontal time (e.g., the nth horizontal time) and outputting the amplified buffer input voltage to the output terminal of the buffer 550.

In other words, when the first sample/hold circuit 541 performs the first drive operation, the second sample/hold circuit 542 may perform the second drive operation. On the contrary, when the second sample/hold circuit 542 performs the first drive operation, the first sample/hold circuit 541 may perform the second drive operation. Since the operation of the first sample/hold circuit 541 and the operation of the second sample/hold circuit 542 are alternately performed as described above, the multi-channel sample/hold circuit 540 may simultaneously perform the first drive operation and the second drive operation.

Due to a parallel connection structure and time-division simultaneous driving of the multi-channel sample/hold circuit 540 as described above, the time required to perform the first drive operation and the second drive operation may be doubled. For example, according to an embodiment of the present inventive concept, the multi-channel sample/hold circuit 540 may ensure one horizontal time (1H) in a time each channel samples the data voltage and maintains the data voltage as the buffer input voltage. Therefore, the multi-channel sample/hold circuit 540 may ensure a sufficient settling time for an output voltage of the buffer 550. As a result, in a high-speed high-resolution display, data signal transmission errors caused by a kickback phenomenon of the output voltage of the buffer 550 may be prevented. Also, a distortion phenomenon of the output voltage of the buffer 550 caused by an RC delay may be reduced.

Referring to FIG. 3, the first sample/hold circuit 541 may include a first sampling capacitor 541*sc* configured to store the buffer input voltage, a first source follower 541*sf* including an input terminal configured to selectively receive the data voltage or the buffer output voltage and an output terminal connected to a first terminal of the first sampling capacitor 541*sc*, a first input switch set sw1 and sw2 configured to selectively apply the data voltage or the buffer output voltage to the input terminal of the first source follower 541*sf*, and a first output switch set sw3 and sw4 configured to control a connection between a second terminal of the first sampling capacitor 541*sc* and first and second input terminals BI1 and BI2 of the buffer 550.

The first sampling capacitor 541*sc* may include a first terminal and a second terminal. The first terminal of the first sampling capacitor 541*sc* may be connected to the output terminal of the first source follower 541*sf*. The second terminal of the first sampling capacitor 541*sc* may be selectively connected to the first input terminal BI1 and the second input terminal BI2 of the buffer 550. The first sampling capacitor 541*sc* may store and maintain the sampled buffer input voltage.

The first source follower 541*sf* may include an input terminal and an output terminal. The input terminal of the first source follower 541*sf* may be connected to the output terminal of the digital-to-analog converter 530 to receive the data voltage. The first source follower 541*sf* may reduce an influence of a parasitic capacitance inside the first sample/hold circuit on the buffer output voltage.

For example, the first source follower 541*sf* may be disposed at a front end of the first sampling capacitor 541*sc* and may be connected to the first sampling capacitor 541*sc*. Such a connection structure (between the first source follower 541*sf* and the first sampling capacitor 541*sc*) may reduce equivalent capacitance inside the first sample/hold circuit 541. Therefore, RC delay generated when the first drive operation of the first sample/hold circuit is performed may be reduced. This may stabilize the buffer output voltage of the first sample/hold circuit.

The first input switch set sw1 and sw2 and the first output switch set sw3 and sw4 may include a plurality of switches sw1, sw2, sw3, and sw4. The switches sw1, sw2, sw3, and sw4 may be implemented, for example, by transistors. The first sample/hold circuit 541 may selectively perform the first drive operation and the second drive operation according to connection control of the first input switch set sw1 and sw2 and the first output switch set sw3 and sw4.

The second sample/hold circuit 542 may include a second sampling capacitor 542*sc* configured to store the buffer input voltage, a second source follower 542*sf* including an input terminal configured to selectively receive the data voltage or the buffer output voltage and an output terminal connected to a first terminal of the second sampling capacitor 542*sc*, a second input switch set sw5 and sw6 configured to selectively apply the data voltage or the buffer output voltage to the input terminal of the second source follower 542*sf*, and a second output switch set sw7 and sw8 configured to control a connection between a second terminal of the second sampling capacitor 542*sc* and the first and second input terminals BI1 and BI2 of the buffer 550.

The second sampling capacitor 542*sc* may include a first terminal and a second terminal. The first terminal of the second sampling capacitor 542*sc* may be connected to the output terminal of the second source follower 542*sf*. The second terminal of the second sampling capacitor 542*sc* may be selectively connected to the first input terminal BI1 and the second input terminal BI2 of the buffer 550. The second sampling capacitor 542*sc* may serve to store and maintain the sampled buffer input voltage.

The second source follower 542*sf* may include an input terminal and an output terminal. The input terminal of the second source follower 542*sf* may be connected to the output terminal of the digital-to-analog converter 530 to receive the data voltage. The second source follower 542*sf* may reduce influence of a parasitic capacitance inside the second sample/hold circuit on the buffer output voltage.

For example, the second source follower 542*sf* may be disposed at a front end of the second sampling capacitor 542*sc* and may be connected to the second sampling capacitor 542*sc*. Such a connection structure (between the second source follower 542*sf* and the second sampling capacitor 542*sc*) may reduce an equivalent capacitance inside the second sample/hold circuit 542. Therefore, RC delay generated when the first drive operation of the second sample/hold circuit is performed may be reduced, to stabilize that the buffer output voltage of the second sample/hold circuit.

The second input switch set sw5 and sw6 and the second output switch set sw7 and sw8 may include a plurality of switches sw5, sw6, sw7, and sw8. In this case, the switches sw5, sw6, sw7, and sw8 may be implemented as transistors. The second sample/hold circuit 542 may selectively perform the first drive operation and the second drive operation according to connection control of the second input switch set sw5 and sw6 and the second output switch set sw7 and sw8.

The output terminal of the buffer 550 and the input terminal of the first source follower 541*sf* may be connected to each other through a first feedback line FB1. The output terminal of the buffer 550 and the input terminal of the second source follower 542*sf* may be connected to each other through a second feedback line FB2.

In one embodiment, the first source follower 541*sf* and the second source follower 542*sf* may be configured as NMOS transistors. For example, the output terminal of the buffer 550 may be connected to the first feedback line FB1 for feeding back the buffer output voltage to the input terminal of the first source follower 541*sf* and the second feedback line FB2 for feeding back the buffer output voltage to the input terminal of the second source follower 542*sf*.

Due to such a buffer output voltage feedback structure, the data voltage input from the digital-to-analog converter 530 may be completely output as the buffer output voltage. For example, when a data voltage Vgamma is applied from the digital-to-analog converter 530 to the input terminal of the first source follower 541*sf*1, a buffer input voltage Vbuffer output from the output terminal of the first source follower 541*sf* may have a value obtained by subtracting a gate source voltage Vgs_541*sf* of the first source follower 541*sf* from the data voltage Vgamma (e.g., Vbuffer=Vgamma−Vgs_541*sf*). When a buffer output voltage Vout is input to the input terminal of the first source follower 541*sf* through the first feedback line FB1, the buffer input voltage Vbuffer after a feedback input application operation may have a value obtained by subtracting the gate source voltage Vgs_541*sf* from the buffer output voltage Vout acquired by gamma input application (e.g., Vbuffer=Vout−Vgs_541*sf*). Therefore, the buffer output voltage Vout acquired by the gamma input application may have a value obtained by adding the gate source voltage Vgs_541*sf* to the buffer input voltage Vbuffer after the feedback input application operation (e.g., Vout=Vbuffer+Vgs_541*sf*). The buffer input voltage Vbuffer after the feedback input application operation may have a value obtained by subtracting the gate source voltage Vgs_541*sf* from the data voltage Vgamma (e.g., Vbuffer=Vgamma—Vgs_541*sf*), so that the buffer output voltage Vout may have substantially the same value as the data voltage Vgamma (e.g., Vout=Vgamma). Therefore, the gate source voltage Vgs_541*sf* may be offset from the buffer output voltage, so that the data voltage Vgamma may be completely output as the buffer output voltage Vout.

In one embodiment, the first source follower 541*sf* and the second source follower 542*sf* may be configured as PMOS transistors. For example, the output terminal of the buffer 550 may be connected to the first feedback line FB1 for feeding back the buffer output voltage to the input terminal of the first source follower 541*sf* and the second feedback line FB2 for feeding back the buffer output voltage to the input terminal of the second source follower 542*sf*.

Due to such a buffer output voltage feedback structure, the data voltage input from the digital-to-analog converter 530 may be completely output as the buffer output voltage. For example, when the data voltage Vgamma is applied from the digital-to-analog converter 530 to the input terminal of the first source follower 541*sf*1, the buffer input voltage Vbuffer output from the output terminal of the first source follower 541*sf* may have a value obtained by adding the gate source voltage Vgs_541*sf* of the first source follower 541*sf* to the data voltage Vgamma (e.g., Vbuffer=Vgamma+Vgs_541*sf*).

In this case, when the buffer output voltage Vout is input to the input terminal of the first source follower 541*sf* through the first feedback line FB1, the buffer input voltage Vbuffer after the feedback input application operation may have a value obtained by adding the gate source voltage Vgs_541*sf* to the buffer output voltage Vout acquired by the gamma input application (e.g., Vbuffer=Vout+Vgs_541*sf*). Therefore, the buffer output voltage Vout acquired by the gamma input application may have a value obtained by subtracting the gate source voltage Vgs_541*sf* from the buffer input voltage Vbuffer after the feedback input application operation (e.g., Vout=Vbuffer−Vgs_541*sf*). The buffer input voltage Vbuffer after the feedback input application operation may have a value obtained by adding the gate source voltage Vgs_541*sf* to the data voltage Vgamma (e.g., Vbuffer=Vgamma+Vgs_541*sf*). As a result, the buffer output voltage Vout may have substantially the same value as the data voltage Vgamma (e.g., Vout=Vgamma). Therefore, the gate source voltage Vgs_541*sf* may be offset from the buffer output voltage, so that the data voltage Vgamma may be completely output as the buffer output voltage Vout.

The first input switch set may include a first switch sw1 and a second switch sw2. The first switch sw1 may be configured to control a connection between the output terminal of the digital-to-analog converter 530 through which the data voltage is output and the input terminal of the first source follower 541*sf*. The second switch sw2 may be located on the first feedback line FB1 and may be configured to control a connection between the output terminal of the buffer 550 and the input terminal of the first source follower 541*sf*.

The first output switch set may include a third switch sw3 and a fourth switch sw4. The fourth switch sw4 may be configured to control a connection between the second terminal of the first sampling capacitor 541*sc* and the first input terminal BI1 of the buffer 550. The third switch sw3 may be configured to control a connection between the second terminal of the first sampling capacitor 541*sc* and the second input terminal B12 of the buffer 550.

The second input switch set may include a fifth switch sw5 and a sixth switch sw6. The fifth switch sw5 may be configured to control a connection between the output terminal of the digital-to-analog converter 530 through which the data voltage is output and the input terminal of the second source follower 542*sf*. The sixth switch sw6 may be located on the second feedback line FB2 and may be configured to control a connection between the output terminal of the buffer 550 and the input terminal of the second source follower 542*sf*.

The second output switch set may include a seventh switch sw7 and an eighth switch sw8. The eighth switch sw8 may be configured to control a connection between the second terminal of the second sampling capacitor 542*sc* and the first input terminal BI1 of the buffer 550. The seventh switch sw7 may be configured to control a connection between the second terminal of second sampling capacitor 542*sc* and the second input terminal BI2 of buffer 550. Embodiments of operations of switches sw1 to sw8 are described with reference to FIG. 4.

Figure 4:
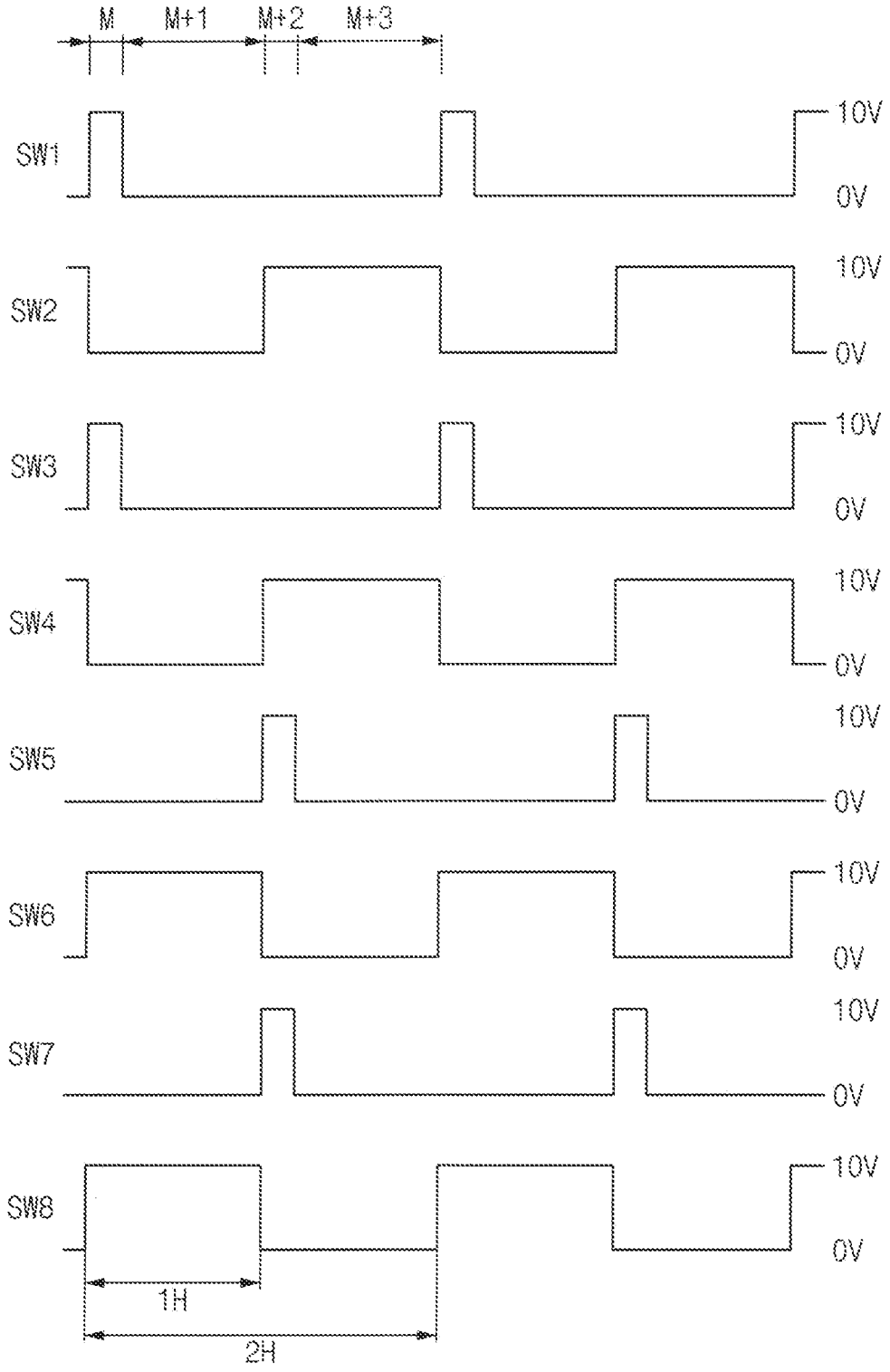
FIG. 4 illustrates an embodiment of signals for operating the analog driving circuit.

FIG. 4 is an embodiment of a timing diagram for operating switches included in the analog driving circuit 520(*k*) of FIG. 3.

Referring to FIGS. 3 and 4, switches sw1 to sw8 may be turned on and off by the switching control signal CTRL1 of the timing controller 200. Switches sw1 to sw8 may be implemented, for example, by transistors, and each of the switches may be turned on when a first predetermined voltage (e.g., 10 V) is applied as an input and turned off when a second predetermined voltage (e.g., 0 V) is applied as an input. However, this is an example of a switching operation, and the turn-on/turn-off voltages may be different in other embodiments, for example, depending on the transistor types used to implement the switches.

Each of the switches sw1 to sw8 may repeatedly perform a predetermined operation at a period of 2H according to the switching control signal CTRL1. In one embodiment, a unit interval at which the switching operation is repeatedly performed (e.g., two horizontal time (2H)) may be divided into an Mth interval, an (M+1)th interval, an (M+2)th interval, and an (M+3)th interval. For example, the sum of the Mth interval and the (M+1)th interval may be one horizontal time (1H), and the sum of the (M+2)th interval and the (M+3)th interval may be one horizontal time (1H).

The first switch sw1 may be turned on during the Mth interval and turned off during the (M+1)th to (M+3)th intervals. The second switch sw2 may be turned off during the Mth and (M+1)th intervals and turned on during the (M+2)th and (M+3)th intervals. The third switch sw3 may be turned on during the Mth interval and turned off during the (M+1)th to (M+3)th intervals. The fourth switch sw4 may be turned off during the Mth and (M+1)th intervals and turned on during the (M+2)th and (M+3)th intervals. The fifth switch sw5 may be turned off during the Mth and (M+1)th intervals, turned on during the (M+2)th interval, and turned off during the (M+3)th interval. The sixth switch sw6 may be turned on during the Mth and (M+1)th intervals and turned off during the (M+2)th and (M+3)th intervals. The seventh switch sw7 may be turned off during the Mth and (M+1)th intervals, turned on during the (M+2)th interval and turned off during the (M+3)th interval. The eighth switch sw8 may be turned on during the Mth and (M+1)th intervals and turned off during the (M+2)th and (M+3)th intervals.

In one embodiment, the first sample/hold circuit 541 may perform the sampling operation during the Mth interval, the holding operation during the (M+1)th interval, and the driving operation during the (M+2)th and (M+3)th intervals. For example, during the Mth interval, the first switch sw1 may be turned on, the second switch sw2 may be turned off, the third switch sw3 may be turned on, and the fourth switch sw4 may be turned off. As a result, the first sample/hold circuit 541 may perform the sampling operation.

During the (M+1)th interval, the first switch sw1 may be turned off, the second switch sw2 may be turned off, the third switch sw3 may be turned off, and the fourth switch sw4 may be turned off. As a result, the first sample/hold circuit 541 may perform the holding operation.

During the (M+2)th and (M+3)th intervals, the first switch sw1 may be turned off, the second switch sw2 may be turned on, the third switch sw3 may be turned off, and the fourth switch sw4 may be turned on. As a result, the first sample/hold circuit 541 may perform the driving operation.

The second sample/hold circuit 542 may perform the driving operation during the Mth and (M+1)th intervals, the sampling operation during the (M+2)th interval, and the holding operation during the (M+3)th interval. For example, during the Mth and (M+1)th intervals, the fifth switch sw5 may be turned off, the sixth switch sw6 may be turned on, the seventh switch sw7 may be turned off, and the eighth switch sw8 may be turned on. As a result, the second sample/hold circuit 542 may perform the driving operation.

During the (M+2)th interval, the fifth switch sw5 may be turned on, the sixth switch sw6 may be turned off, the seventh switch sw7 may be turned on, and the eighth switch sw8 may be turned off. As a result, the second sample/hold circuit 542 may perform the sampling operation.

During the (M+3)th interval, the fifth switch sw5 may be turned off, the sixth switch sw6 may be turned off, the seventh switch sw7 may be turned off, and the eighth switch sw8 may be turned off. As a result, the second sample/hold circuit 542 may perform the holding operation.

The buffer input voltage may be divided into a first buffer input voltage according to driving of the first sample/hold circuit 541 and a second buffer input voltage according to driving of the second sample/hold circuit 542. For example, when the first sample/hold circuit 541 performs the first drive operation, the first buffer input voltage may be stored and maintained in the first sampling capacitor 541*sc*. When the first sample/hold circuit 541 performs the second drive operation, the first buffer input voltage may be input to the first input terminal BI1 of the buffer 550. When the second sample/hold circuit 542 performs the first drive operation, the second buffer input voltage may be stored and maintained in the second sampling capacitor 542*sc*. When the second sample/hold circuit 542 performs the second drive operation, the second buffer input voltage may be input to the first input terminal BI1 of the buffer 550.

As described above, the first buffer input voltage and the second buffer input voltage are alternately inputted to the first input terminal BI1 of the buffer 550, so that the buffer output voltage may be maintained at a predetermined level. For example, while the second sample/hold circuit 542 performs the driving operation during the Mth and (M+1)th intervals, the second buffer input voltage may be input to the first input terminal BI1 of the buffer 550 to maintain the buffer output voltage. While the first sample/hold circuit 541 performs the driving operation during the (M+2)th and (M+3)th intervals, the first buffer input voltage may be input to the first input terminal BI1 of the buffer 550 to maintain the buffer output voltage.

Figure 5:
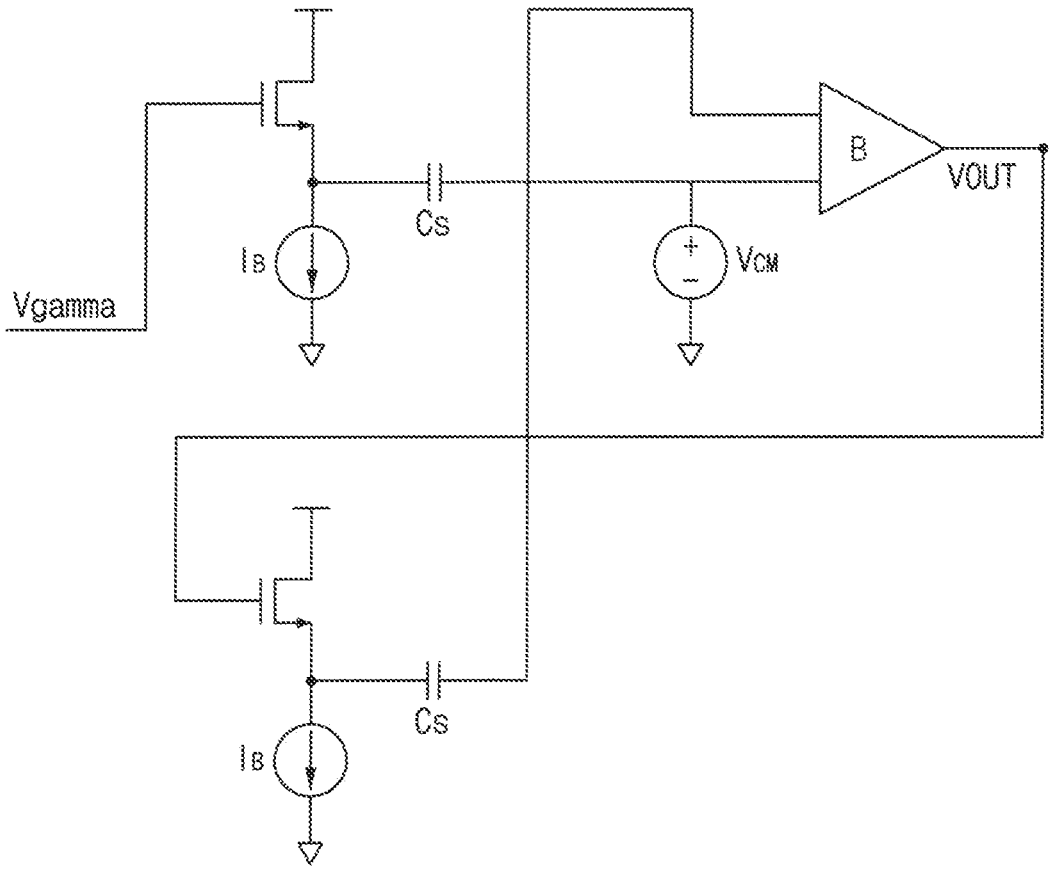
FIG. 5 illustrates is a diagram for describing that a first sample/hold circuit performs a sampling operation and a second sample/hold circuit performs a driving operation in the analog driving circuit of FIG. 3 according to an embodiment.

FIG. 5 is a diagram for describing an embodiment where first sample/hold circuit 541 performs a sampling operation and second sample/hold circuit 542 performs a driving operation in the analog driving circuit 520(*k*) of FIG. 3.

Referring to FIG. 5, when the first sample/hold circuit 541 performs the sampling operation and the second sample/hold circuit 542 performs the driving operation, the first switch sw1 may be turned on, the second switch sw2 may be turned off, the third switch sw3 may be turned on, the fourth switch sw4 may be turned off, the fifth switch sw5 may be turned off, the sixth switch sw6 may be turned on, the seventh switch sw7 may be turned off, and the eighth switch sw8 may be turned on.

For example, when the first sample/hold circuit 541 performs the sampling operation, the output terminal of the digital-to-analog converter 530 through which the data voltage is output may be connected to the input terminal of the first source follower 541*sf*, and the second terminal of the first sampling capacitor 541*sc* may be connected to the second input terminal BI2 of the buffer 550. When the second sample/hold circuit 542 performs the driving operation, the second terminal of the second sampling capacitor 542*sc* may be connected to the first input terminal BI1 of the buffer 550, and the output terminal of the buffer 550 may be connected to the input terminal of the second source follower 542*sf* through the second feedback line FB2.

When, for example, the first switch sw1 is turned on, the second switch sw2 is turned off, the third switch sw3 is turned on and the fourth switch sw4 is turned off, the output terminal of the digital-to-analog converter 530 through which the data voltage is output may be connected to the input terminal of the first source follower 541*sf*, and the second terminal of the first sampling capacitor 541*sc* may be connected to the second input terminal BI2 of the buffer 550. As a result, the data voltage may be sampled as the first buffer input voltage.

When the fifth switch sw5 is turned off, the sixth switch sw6 is turned on, the seventh switch sw7 is turned off, and the eighth switch sw8 is turned on, the second terminal of the second sampling capacitor 542*sc* may be connected to the first input terminal BI1 of the buffer 550, and the output terminal of the buffer 550 may be connected to the input terminal of the second source follower 542*sf* through the second feedback line FB2. As a result, the second buffer input voltage may be input to the first input terminal BI1 of the buffer 550.

Figure 6:
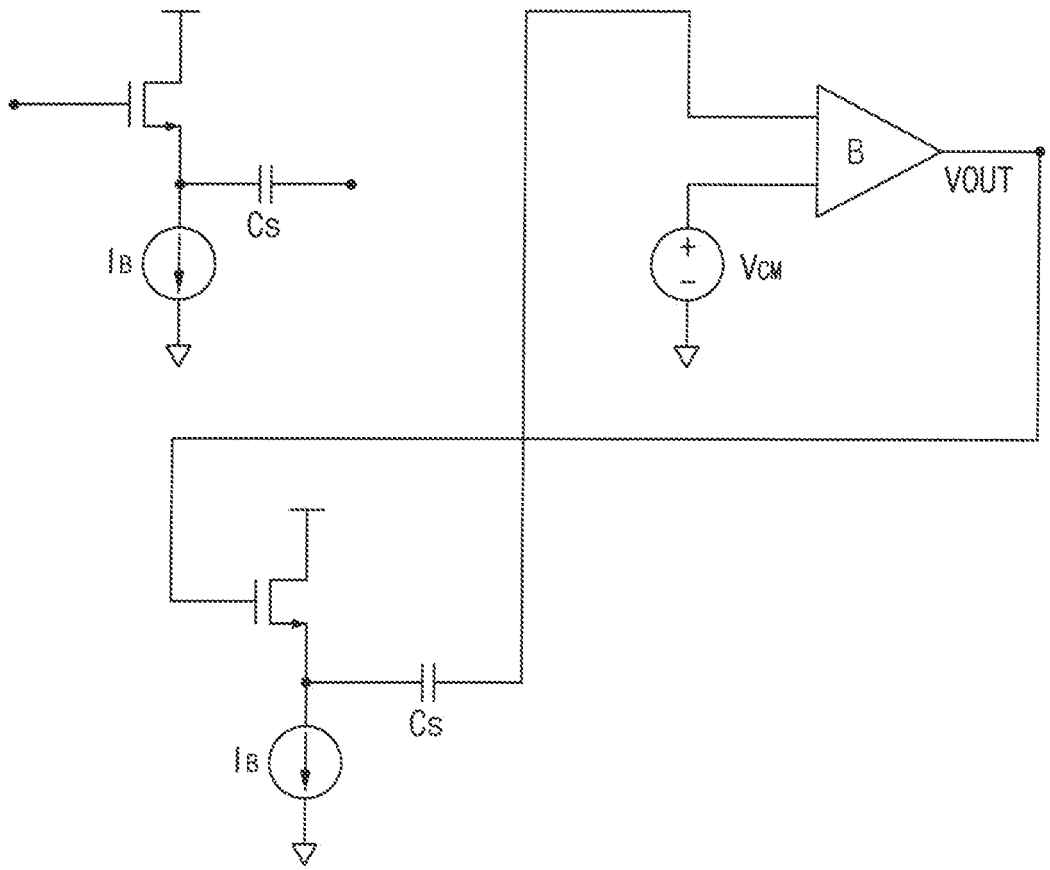
FIG. 6 illustrates a diagram for describing that the first sample/hold circuit performs a holding operation and the second sample/hold circuit performs the driving operation in the analog driving circuit of FIG. 3 according to an embodiment.

FIG. 6 is a diagram for describing an embodiment where the first sample/hold circuit 541 performs a holding operation and the second sample/hold circuit 542 performs the driving operation in the analog driving circuit 520(*k*) of FIG. 3.

Referring to FIG. 6, when the first sample/hold circuit 541 performs the holding operation and the second sample/hold circuit 542 performs the driving operation, the first switch sw1 may be turned off, the second switch sw2 may be turned off, the third switch sw3 may be turned off, the fourth switch sw4 may be turned off, the fifth switch sw5 may be turned off, the sixth switch sw6 may be turned on, the seventh switch sw7 may be turned off, and the eighth switch sw8 may be turned on.

For example, when the first sample/hold circuit 541 performs the holding operation, the input terminal of the first source follower 541*sf* and the second terminal of the first sampling capacitor 541*sc* may be disconnected from the multi-channel sample/hold circuit. When the second sample/hold circuit 542 performs the driving operation, the second terminal of the second sampling capacitor 542*sc* may be connected to the first input terminal BI1 of the buffer 550, and the output terminal of the buffer 550 may be connected to the input terminal of the second source follower 542*sf* through the second feedback line FB2.

When, for example, the first switch sw1 is turned off, the second switch sw2 is turned off, the third switch sw3 is turned off and the fourth switch sw4 is turned off, the input terminal of the first source follower 541*sf* and the second terminal of the first sampling capacitor 541*sc* may be disconnected from the multi-channel sample/hold circuit. As a result, the first buffer input voltage may be maintained in the first sampling capacitor 541*sc*.

When the fifth switch sw5 is turned off, the sixth switch sw6 is turned on, the seventh switch sw7 is turned off and the eighth switch sw8 is turned on, the second terminal of the second sampling capacitor 542*sc* may be connected to the first input terminal BI1 of the buffer 550, and the output terminal of the buffer 550 may be connected to the input terminal of the second source follower 542*sf* through the second feedback line FB2. As a result, the second buffer input voltage may be input to the first input terminal BI1 of the buffer 550.

Figure 7:
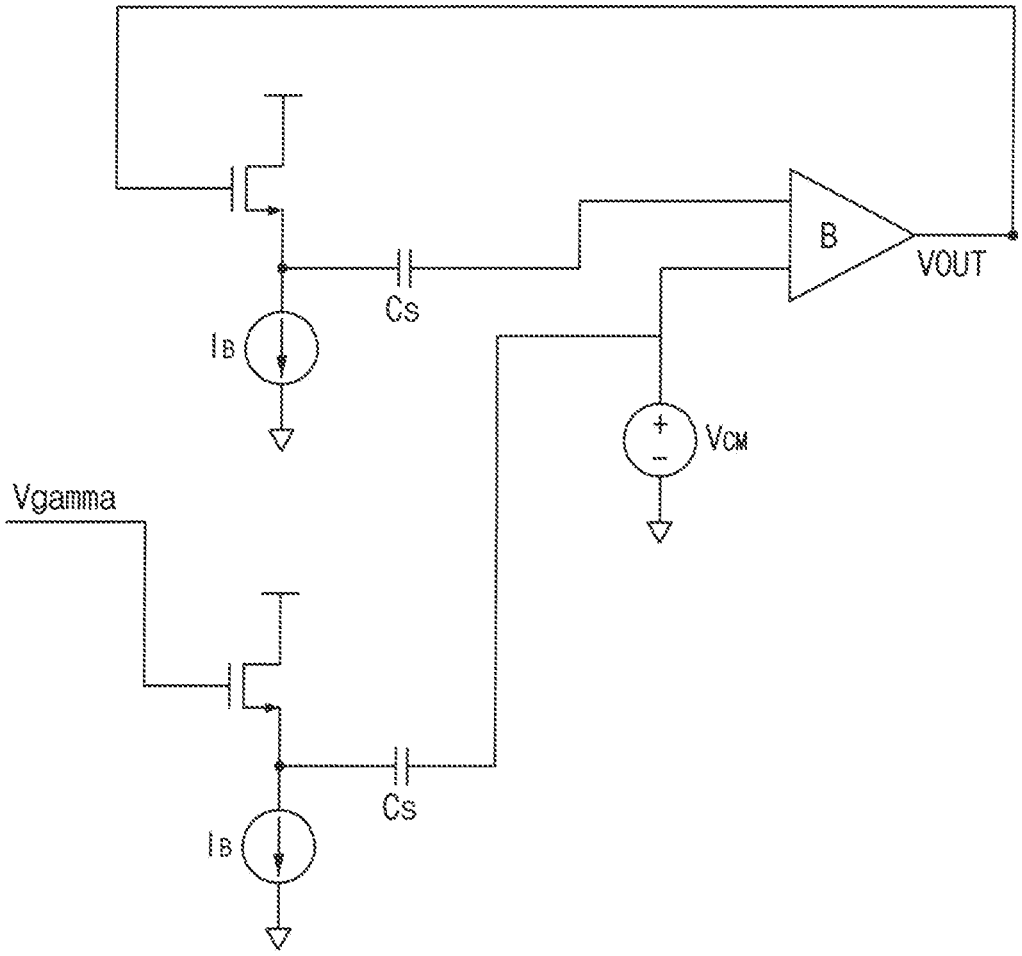
FIG. 7 illustrates a diagram for describing that the first sample/hold circuit performs the driving operation and the second sample/hold circuit performs the sampling operation in the analog driving circuit of FIG. 3 according to an embodiment.

FIG. 7 is a diagram for describing an embodiment where the first sample/hold circuit 541 performs the driving operation and the second sample/hold circuit 542 performs the sampling operation in the analog driving circuit 520(*k*) of FIG. 3.

Referring to FIG. 7, when the first sample/hold circuit 541 performs the driving operation and the second sample/hold circuit 542 performs the sampling operation, the first switch sw1 may be turned off, the second switch sw2 may be turned on, the third switch sw3 may be turned off, the fourth switch sw4 may be turned on, the fifth switch sw5 may be turned on, the sixth switch sw6 may be turned off, the seventh switch sw7 may be turned on, and the eighth switch sw8 may be turned off.

For example, when the first sample/hold circuit 541 performs the driving operation, the second terminal of the first sampling capacitor 541*sc* may be connected to the first input terminal BI1 of the buffer 550, and the output terminal of the buffer 550 may be connected to the input terminal of the first source follower 541*sf* through the first feedback line FB1.

When the second sample/hold circuit 542 performs the sampling operation, the output terminal of the digital-to-analog converter 530 through which the data voltage is output may be connected to the input terminal of the second source follower 542*sf*, and the second terminal of the second sampling capacitor 542*sc* may be connected to the second input terminal BI2 of the buffer 550.

When, for example, the first switch sw1 is turned off, the second switch sw2 is turned on, the third switch sw3 is turned off and the fourth switch sw4 is turned on, the second terminal of the first sampling capacitor 541*sc* may be connected to the first input terminal BI1 of the buffer 550, and the output terminal of the buffer 550 may be connected to the input terminal of the first source follower 541*sf* through the first feedback line FB1. As a result, the first buffer input voltage may be input to the first input terminal BI1 of the buffer 550.

When the fifth switch sw5 is turned on, the sixth switch sw6 is turned off, the seventh switch sw7 is turned on and the eighth switch sw8 is turned off, the output terminal of the digital-to-analog converter 530 through which the data voltage is output may be connected to the input terminal of the second source follower 542*sf*, and the second terminal of the second sampling capacitor 542*sc* may be connected to the second input terminal BI2 of the buffer 550. As a result, the data voltage may be sampled as the second buffer input voltage.

Figure 8:
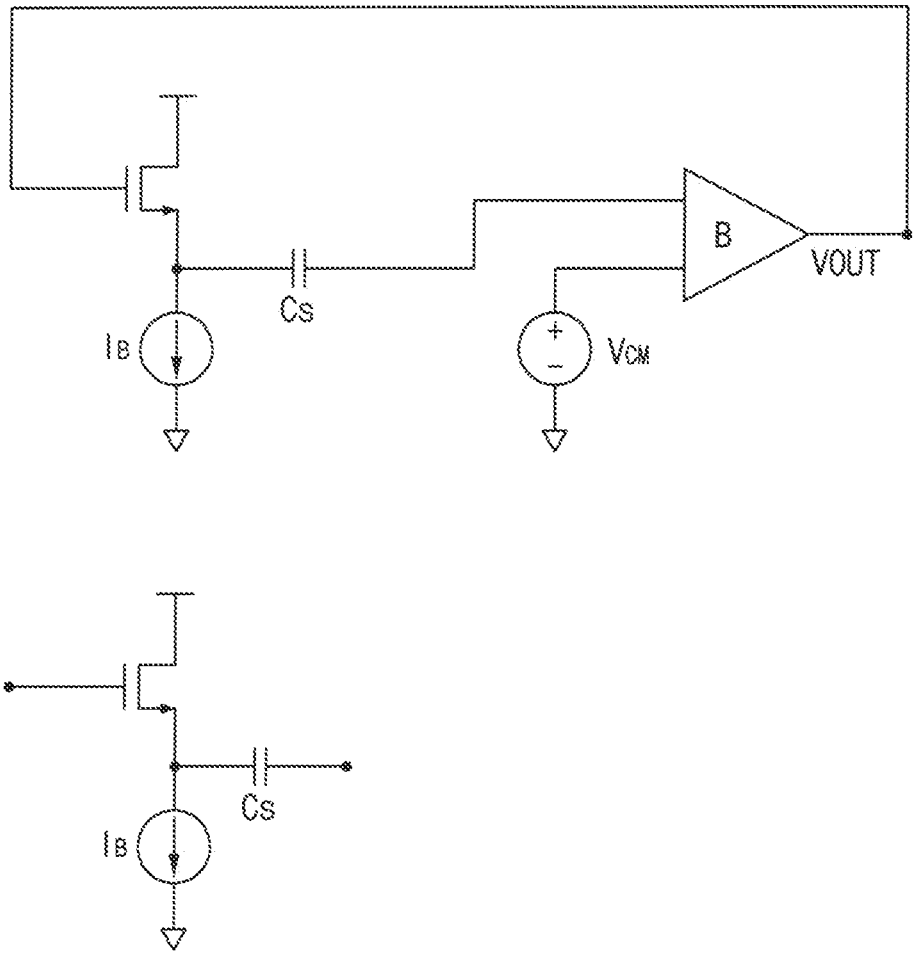
FIG. 8 illustrates a diagram for describing that the first sample/hold circuit performs the driving operation and the second sample/hold circuit performs the holding operation in the analog driving circuit of FIG. 3 according to an embodiment.

FIG. 8 is a diagram for describing an embodiment where the first sample/hold circuit 541 performs the driving operation and the second sample/hold circuit 542 performs the holding operation in the analog driving circuit 520(*k*) of FIG. 3.

Referring to FIG. 8, when the first sample/hold circuit 541 performs the driving operation and the second sample/hold circuit 542 performs the holding operation, the first switch sw1 may be turned off, the second switch sw2 may be turned on, the third switch sw3 may be turned off, the fourth switch sw4 may be turned on, the fifth switch sw5 may be turned off, the sixth switch sw6 may be turned off, the seventh switch sw7 may be turned off, and the eighth switch sw8 may be turned off.

For example, when the first sample/hold circuit 541 performs the driving operation, the second terminal of the first sampling capacitor 541*sc* may be connected to the first input terminal BI1 of the buffer 550, and the output terminal of the buffer 550 may be connected to the input terminal of the first source follower 541*sf* through the first feedback line FB1.

When the second sample/hold circuit 542 performs the holding operation, the input terminal of the second source follower 542*sf* and the second terminal of the second sampling capacitor 542*sc* may be disconnected from the multi-channel sample/hold circuit.

When, for example, the first switch sw1 is turned off, the second switch sw2 is turned on, the third switch sw3 is turned off and the fourth switch sw4 is turned on, the second terminal of the first sampling capacitor 541*sc* may be connected to the first input terminal BI1 of the buffer 550, and the output terminal of the buffer 550 may be connected to the input terminal of the first source follower 541*sf* through the first feedback line FB1. As a result, the first buffer input voltage may be input to the first input terminal BI1 of the buffer 550.

When the fifth switch sw5 is turned off, the sixth switch sw6 is turned off, the seventh switch sw7 is turned off and the eighth switch sw8 is turned off, the input terminal of the second source follower 542*sf* and the second terminal of the second sampling capacitor 542*sc* may be disconnected from the multi-channel sample/hold circuit. As a result, the second buffer input voltage may be maintained in the second sampling capacitor 542*sc*.

As described above, according to control of switches sw1 to sw8, the second sample/hold circuit 542 may perform the driving operation while the first sample/hold circuit 541 performs the sampling operation and the holding operation. Also, the first sample/hold circuit 541 may perform the driving operation while the second sample/hold circuit 542 performs the sampling operation and the holding operation.

Due to the parallel connection structure and the time-division simultaneous driving of the first sample/hold circuit 541 and the second sample/hold circuit 542 as described above, the time to perform the first drive operation and the second drive operation may be doubled, e.g., according to an embodiment of the present inventive concept, the multi-channel sample/hold circuit 540 may ensure one horizontal time (1H) in the time each channel samples the data voltage and maintains the data voltage as the buffer input voltage. Therefore, the multi-channel sample/hold circuit 540 may ensure a sufficient settling time for the output voltage of the buffer 550. As a result, in the high-speed high-resolution display, data signal transmission errors caused by a kickback phenomenon of the output voltage of buffer 550 may be prevented. Also, distortion phenomenon of the output voltage of the buffer 550 caused by the RC delay may be reduced.

Figure 9:
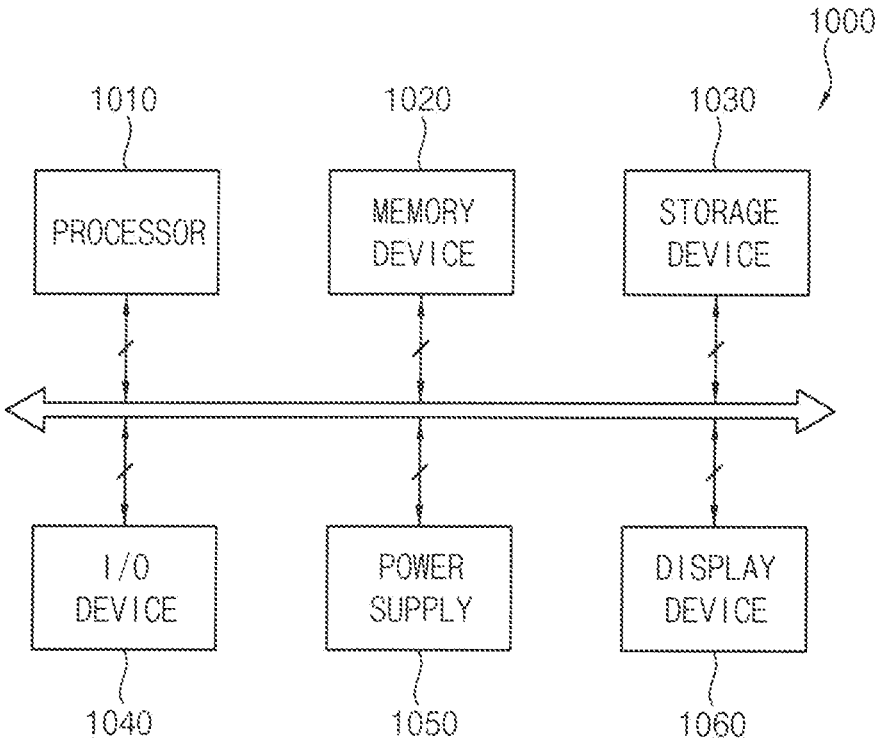
FIG. 9 illustrates an embodiment of an electronic device.
Figure 10:
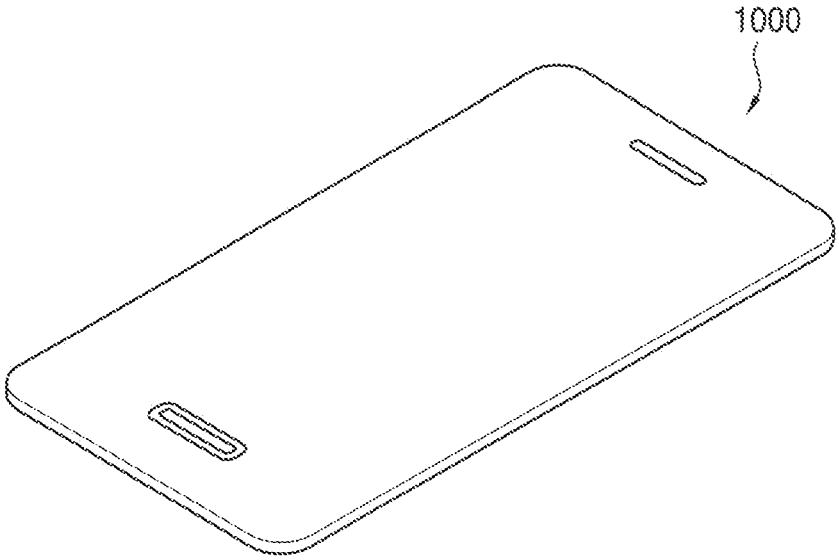
FIG. 10 illustrates an embodiment of a smartphone.

FIG. 9 is a block diagram illustrating an electronic device 1000 according to the embodiments of the present inventive concept. FIG. 10 is a diagram illustrating an example in which the electronic device 1000 of FIG. 11 is implemented as a smart phone.

Referring to FIGS. 9 and 10, the electronic device 1000 may include a processor 1010, a memory device 1020, a storage device 1030, an input/output (I/O) device 1040, a power supply 1050, and a display device 1060. In addition, the electronic device 1000 may include a plurality of ports for communicating with a video card, a sound card, a memory card, a universal serial bus (USB) device, other electronic device, and the like. In an embodiment, as illustrated in FIG. 10, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, or another device.

The processor 1010 may perform various computing functions. The processor 1010 may be a microprocessor, a central processing unit (CPU), an application processor (AP), or another type of processor. The processor 1010 may be coupled to other components via an address bus, a control bus, a data bus, and the like. Further, the processor 1010 may be coupled to an extended bus such as a peripheral component interconnection (PCI) bus.

The memory device 1020 may store data for operations of the electronic device 1000. For example, the memory device 1020 may include at least one non-volatile memory device. Examples include an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, or the like.

The storage device 1030 may include a solid state drive (SSD) device, a hard disk drive (HDD) device, a CD-ROM device, or another type of device.

The I/O device 1040 may include an input device such as a keyboard, a keypad, a mouse device, a touch-pad, a touch-screen, and the like, and an output device such as a printer, a speaker, and the like. In some embodiments, the I/O device 1040 may include the display device 1060.

The power supply 1050 may provide power for operations of electronic device 1000.

The display device 1060 may display an image corresponding to visual information of the electronic device 1000. The display device 1060 may include a data driver configured to apply analog data voltages to a display panel. The data driver may include a digital-to-analog converter configured to convert a digital data signal to an analog data voltage, a buffer configured to output the data voltage and a multi-channel sample/hold circuit located between the digital-to-analog converter and the buffer and including a first sample/hold circuit connected to a first channel and a second sample/hold circuit connected to a second channel.

In accordance with one or more embodiments, the first sample/hold circuit is configured to perform a first drive operation of sampling the data voltage as a buffer input voltage and maintaining the buffer input voltage during an nth horizontal time (where n is an integer greater than or equal to 1). The first sample/hold circuit is also configured to perform a second drive operation of outputting the buffer input voltage to an output terminal of the buffer during an (n+1)th horizontal time.

The second sample/hold circuit is configured to perform the second drive operation during the nth horizontal time and perform the first drive operation during the (n+1)th horizontal time.

The display device 1060 including the data driver may be subject to time-division simultaneous driving such that a driving operation is performed in the second sample/hold circuit when a sampling operation and a holding operation are performed in the first sample/hold circuit, and the driving operation is performed in the first sample/hold circuit when the sampling operation and the holding operation are performed in the second sample/hold circuit. As a result, the time for the sampling and holding operations can be doubled in a high-speed high-resolution display. As a result, a settling time for the buffer input voltage can be increased, so that signal distortion and signal transmission errors can be prevented. However, since these are described above, duplicated description related thereto will not be repeated.

In accordance with one embodiment, a multi-channel sample/hold circuit includes a first sample/hold circuit connected to a first channel and a second sample/hold circuit connected to a second channel. The first sample/hold circuit performs a first drive operation and a second drive operation. The first drive operation includes sampling a data voltage as a buffer input voltage and maintaining the buffer input voltage during an $n^{th}$ horizontal time. The second drive operation includes outputting the buffer input voltage to an output terminal of the buffer during an $(n+1)^{th}$ horizontal time. The second sample/hold circuit is configured to perform the second drive operation during the $n^{th}$ horizontal time and to perform the first drive operation during the $(n+1)^{th}$ horizontal time, where n is an integer greater than or equal to 1. Such a multi-channel sample/hold circuit may be used for displaying image data in a display device, or may be used in any another application wherein data sample and hold operations are to be performed.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments or operations of the apparatus embodiments herein.

The controllers, processors, devices, modules, units, multiplexers, generators, logic, interfaces, decoders, converters, drivers, generators and other signal generating and signal processing features of the embodiments disclosed herein may be implemented, for example, in non-transitory logic that may include hardware, software, or both. When implemented at least partially in hardware, the controllers, processors, devices, modules, converters, units, multiplexers, generators, logic, interfaces, decoders, drivers, generators and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, processors, devices, modules, units, multiplexers, generators, logic, converters, interfaces, decoders, drivers, generators and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings of the present inventive concept. Accordingly, such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein. The embodiments may be combined to form additional embodiments.

What is claimed is:

1. A data driver, comprising:

a digital-to-analog converter configured to convert a digital data signal to an analog data voltage;

a buffer configured to output the data voltage; and a multi-channel sample/hold circuit electrically connected between the digital-to-analog converter and the buffer, the multi-channel sample/hold circuit including a first sample/hold circuit connected to a first channel and a second sample/hold circuit connected to a second channel, wherein:

the first sample/hold circuit is configured to have a source-follower structure to perform a first drive operation of sampling the data voltage as a buffer input voltage and maintaining the buffer input voltage during an $n^{th}$ horizontal time, and configured to perform a second drive operation of outputting the buffer input voltage to an output terminal of the buffer during an $(n+1)^{th}$ horizontal time, wherein the output terminal of the buffer is selectively coupled to the first sample/hold circuit along a first feedback line; and the second sample/hold circuit is configured to perform the second drive operation during the $n^{th}$ horizontal time and to perform the first drive operation during the $(n+1)^{th}$ horizontal time, where n is an integer greater than or equal to 1, wherein the output terminal of the buffer is selectively coupled to the second sample/hold circuit along a second feedback line.

2. A data driver comprising, a digital-to-analog converter configured to convert a digital data signal to an analog data voltage;

a buffer configured to output the data voltage; and a multi-channel sample/hold circuit electrically connected between the digital-to-analog converter and the buffer, the multi-channel sample/hold circuit including a first sample/hold circuit connected to a first channel and a second sample/hold circuit connected to a second channel, wherein:

the first sample/hold circuit is configured to have a source-follower structure to perform a first drive operation of sampling the data voltage as a buffer input voltage and maintaining the buffer input voltage during an n® horizontal time, and configured to perform a second drive operation of outputting the buffer input voltage to an output terminal of the buffer during an n+1)" horizontal time, and the second sample/hold circuit is configured to perform the second drive operation during the n™ horizontal time and to perform the first drive operation during the (n+1)" horizontal time, where n is an integer greater than or equal to 1, wherein the first sample/hold circuit includes:

a first sampling capacitor configured to store the buffer input voltage;

a first source follower including an input terminal configured to selectively receive the data voltage or the buffer output voltage and an output terminal connected to a first terminal of the first sampling capacitor;

a first input switch set configured to selectively apply the data voltage or the buffer output voltage to the input terminal of the first source follower; and a first output switch set configured to control a connection between a second terminal of the first sampling capacitor and first and second input terminals of the buffer.

3. The data driver of claim 2, wherein the second sample/hold circuit includes:

a second sampling capacitor configured to store the buffer input voltage;

a second source follower including an input terminal configured to selectively receive the data voltage or the buffer output voltage and an output terminal connected to a first terminal of the second sampling capacitor;

a second input switch set configured to selectively apply the data voltage or the buffer output voltage to the input terminal of the second source follower; and a second output switch set configured to control a connection between a second terminal of the second sampling capacitor and the first and second input terminals of the buffer.

4. The data driver of claim 3, wherein:

the output terminal of the buffer is connected to the input terminal of the first source follower through the first feedback line, and the output terminal of the buffer is connected to the input terminal of the second source follower through the second feedback line.

5. The data driver of claim 4, wherein the first input switch set includes:

a first switch configured to control a connection between an output terminal of the digital-to-analog converter through which the data voltage is output and the input terminal of the first source follower; and a second switch located on the first feedback line and configured to control a connection between the output terminal of the buffer and the input terminal of the first source follower.

6. The data driver of claim 5, wherein the first output switch set includes:

a fourth switch configured to control a connection between the second terminal of the first sampling capacitor and the first input terminal of the buffer; and a third switch configured to control a connection between the second terminal of the first sampling capacitor and the second input terminal of the buffer.

7. The data driver of claim 6, wherein the second input switch set includes:

a fifth switch configured to control a connection between the output terminal of the digital-to-analog converter through which the data voltage is output and the input terminal of the second source follower; and a sixth switch located on the second feedback line and configured to control a connection between the output terminal of the buffer and the input terminal of the second source follower.

8. The data driver of claim 7, wherein the second output switch set includes:

an eighth switch configured to control a connection between the second terminal of the second sampling capacitor and the first input terminal of the buffer; and a seventh switch configured to control a connection between the second terminal of the second sampling capacitor and the second input terminal of the buffer.

9. The data driver of claim 8, wherein:

when the first sample/hold circuit performs the first drive operation, the sixth switch and the eighth switch are turned on and the second switch, the fourth switch, the fifth switch, and the seventh switch are turned off.

10. The data driver of claim 8, wherein:

when the first sample/hold circuit performs the second drive operation, the second switch and the fourth switch are turned on and the first switch, the third switch, the sixth switch, and the eighth switch are turned off.

11. The data driver of claim 8, wherein:

the first sample/hold circuit is configured to sample the data voltage as the buffer input voltage when the first switch, the third switch, the sixth switch, and the eighth switch are turned on and the second switch, the fourth switch, the fifth switch, and the seventh switch are turned off, and the first sample/hold circuit is configured to maintain the buffer input voltage when the sixth switch and the eighth switch are turned on and the first switch, the second switch, the third switch, the fourth switch, the fifth switch, and the seventh switch are turned off.

12. The data driver of claim 8, wherein:

when the second sample/hold circuit performs the first drive operation, the second switch and the fourth switch are turned on and the first switch, the third switch, the sixth switch, and the eighth switch are turned off.

13. The data driver of claim 8, wherein:

when the second sample/hold circuit performs the second drive operation, the sixth switch and the eighth switch are turned on and the second switch, the fourth switch, the fifth switch, and the seventh switch are turned off.

14. The data driver of claim 8, wherein:

the second sample/hold circuit is configured to sample the data voltage as the buffer input voltage when the second switch, the fourth switch, the fifth switch, and the seventh switch are turned on and the first switch, the third switch, the sixth switch, and the eighth switch are turned off, and the second sample/hold circuit is configured to maintain the buffer input voltage when the second switch and the fourth switch are turned on and the first switch, the third switch, the fifth switch, the sixth switch, the seventh switch, and the eighth switch are turned off.

15. A display device, comprising:

a display panel;

a gate driver configured to apply a gate signal to the display panel;

a data driver configured to apply an analog data voltage to the display panel; and a timing controller configured to control the gate driver and the data driver, wherein the data driver includes:

a digital-to-analog converter configured to convert a digital data signal to an analog data voltage;

a buffer configured to output the data voltage; and a multi-channel sample/hold circuit electrically connected between the digital-to-analog converter and the buffer, the multi-channel sample/hold circuit including a first sample/hold circuit connected to a first channel and a second sample/hold circuit connected to a second channel, wherein:

the first sample/hold circuit is configured to have a source-follower structure to perform a first drive operation of sampling the data voltage as a buffer input voltage and maintaining the buffer input voltage during an $n^{th}$ horizontal time, and configured to perform a second drive operation of outputting the buffer input voltage to an output terminal of the buffer during an $(n+1)^{th}$ horizontal time, wherein the output terminal of the buffer is selectively coupled to the first sample/hold circuit along a first feedback line, and the second sample/hold circuit is configured to perform the second drive operation during the $n^{th}$ horizontal time and perform the first drive operation during the $(n+1)^{th}$ horizontal time, where n is an integer greater than or equal to 1, wherein the output terminal of the buffer is selectively coupled to the second sample/hold circuit along a second feedback line.

16. The display device of claim 15, wherein the first sample/hold circuit includes:

a first sampling capacitor configured to store the buffer input voltage;

a first source follower including an input terminal configured to selectively receive the data voltage or the buffer output voltage and an output terminal connected to a first terminal of the first sampling capacitor;

a first input switch set configured to selectively apply the data voltage or the buffer output voltage to the input terminal of the first source follower; and a first output switch set configured to control a connection between a second terminal of the first sampling capacitor and first and second input terminals of the buffer.

17. The display device of claim 16, wherein the second sample/hold circuit includes:

a second sampling capacitor configured to store the buffer input voltage;

a second source follower including an input terminal configured to selectively receive the data voltage or the buffer output voltage and an output terminal connected to a first terminal of the second sampling capacitor;

a second input switch set configured to selectively apply the data voltage or the buffer output voltage to the input terminal of the second source follower; and a second output switch set configured to control a connection between a second terminal of the second sampling capacitor and the first and second input terminals of the buffer.

18. The display device of claim 17, wherein:

the output terminal of the buffer and the input terminal of the first source follower are connected to each other through the first feedback line, and the output terminal of the buffer and the input terminal of the second source follower are connected to each other through the second feedback line.

19. The display device of claim 18, wherein the first input switch set includes:

a first switch configured to control a connection between an output terminal of the digital-to-analog converter through which the data voltage is output and the input terminal of the first source follower; and a second switch located on the first feedback line and configured to control a connection between the output terminal of the buffer and the input terminal of the first source follower, and wherein the first output switch set includes:

a fourth switch configured to control a connection between the second terminal of the first sampling capacitor and the first input terminal of the buffer; and a third switch configured to control a connection between the second terminal of the first sampling capacitor and the second input terminal of the buffer.

20. The display device of claim 19, wherein the second input switch set includes:

a fifth switch configured to control a connection between the output terminal of the digital-to-analog converter through which the data voltage is output and the input terminal of the second source follower; and a sixth switch located on the second feedback line and configured to control a connection between the output terminal of the buffer and the input terminal of the second source follower, and wherein the second output switch set includes:

an eighth switch configured to control a connection between the second terminal of the second sampling capacitor and the first input terminal of the buffer; and a seventh switch configured to control a connection between the second terminal of the second sampling capacitor and the second input terminal of the buffer.

* * * * *